US006296315B1

(12) United States Patent
Jensen

(10) Patent No.: US 6,296,315 B1
(45) Date of Patent: Oct. 2, 2001

(54) SEATING FURNITURE FOR MOUNTING ON A CARRIER ELEMENT AND PLATE FOR THE BACK OF SUCH A SEATING FURNITURE

(76) Inventor: Uffe Jensen, Fasanvej 11, Brønderslev, 9700 (DK)

( * ) Notice: Subject to any disclaimer, the term of this patent is extended or adjusted under 35 U.S.C. 154(b) by 0 days.

(21) Appl. No.: 09/403,948

(22) PCT Filed: Apr. 8, 1998

(86) PCT No.: PCT/DK98/00152

§ 371 Date: Oct. 29, 1999

§ 102(e) Date: Oct. 29, 1999

(87) PCT Pub. No.: WO98/48669

PCT Pub. Date: Nov. 5, 1998

(30) Foreign Application Priority Data

Apr. 30, 1997 (DK) ..... 0479/97

(51) Int. Cl.[7] ..... A47C 7/02; A47C 15/00

(52) U.S. Cl. ..... 297/452.14; 297/452.15; 297/232; 52/8

(58) Field of Search ..... 297/232, 452.14, 297/452.15, 452.1; 52/8

(56) References Cited

U.S. PATENT DOCUMENTS

| | | | | |
|---|---|---|---|---|
| 3,885,766 | * | 5/1975 | Resch et al. | 297/232 X |
| 3,893,729 | * | 7/1975 | Sherman et al. | 297/232 X |
| 4,277,101 | * | 7/1981 | Vogel | 297/232 |
| 4,730,873 | * | 3/1988 | Janz | 297/232 X |
| 4,850,159 | | 7/1989 | Conner | 52/9 |
| 4,989,915 | * | 2/1991 | Hansal | 297/232 X |
| 5,292,177 | * | 3/1994 | Balderi et al. | 297/232 |
| 5,328,231 | * | 7/1994 | Raymond | 297/232 X |
| 5,470,128 | * | 11/1995 | Kerkham | 297/232 |
| 5,727,845 | * | 3/1998 | Jackson-Wynch | 297/232 X |
| 5,957,529 | * | 9/1999 | Schrewe | 297/232 |
| 6,095,603 | * | 8/2000 | Hock | 297/232 |

FOREIGN PATENT DOCUMENTS

| | | |
|---|---|---|
| 4039783 | 12/1991 | (DE) . |
| 367900 | 6/1989 | (EP) . |
| 1296128 | 4/1970 | (GB) . |
| 176681 | 1/1995 | (NO) . |

* cited by examiner

*Primary Examiner*—Peter M. Cuomo
*Assistant Examiner*—Rodney B. White
(74) *Attorney, Agent, or Firm*—Merchant & Gould P.C.

(57) ABSTRACT

Seating furniture can be configured for mounting on a carrier element. The carrier element may be part of a stand in a stadium, a frame for a park bench or a carrier element mounted on other established foundations or on other natural foundations. The chair distinguishes itself in that the chair can be mounted on or demounted from the carrier element without difficulty. The chair includes a profile provided with jaws extending around the carrier element and which is fastened to the carrier element. As a result, it is much faster to provide new seats, for example in a stadium, and it is easier to replace individual chairs which may have been damaged. In a preferred embodiment the chair is provided with a pivotable seat. In alternative embodiments, a back of the chair is also pivotable, just as the seat and the back may extend over more seats and thus constitute a bench.

26 Claims, 3 Drawing Sheets

SEATING FURNITURE FOR MOUNTING ON A CARRIER ELEMENT AND PLATE FOR THE BACK OF SUCH A SEATING FURNITURE

BACKGROUND OF THE INVENTION

The present invention relates to seating furniture for mounting, by means of a fastening means, on a carrier element fastened to a natural or established foundation, and said seating furniture comprising at least a seat with a sitting surface.

EP 0 367 900 discloses a chair for a stadium. The chair is fastened to a carrier beam by means of a first bracket. The carrier beam is fastened to a stand in a stadium by means of a second bracket. The chair and the first bracket are interconnected by bolts mounted in holes in the bracket and fastened to a lower side of a seat on the chair.

Said chair possesses certain disadvantages. Mounting the chair on the carrier beam requires partly that the chair is held firmly to the upper side of the carrier beam, partly that the first bracket is held firmly to the lower side of the carrier beam, and partly that the bolts are first mounted in holes in the bracket and then fastened to the lower side of the chair. This means that it is very difficult for a person to have to both hold the chair, hold the bracket and then to have to fit and fasten the bolts to the lower side of the chair. It also means that it is difficult and time consuming to replace chairs if the chairs are damaged or if the chairs need to be replaced for other reasons. It takes more than one person with two hands to mount and fasten and/or loosen and demount the chair from the carrier beam.

NO 176681 discloses a mounting device for a bench. The mounting device comprises an insertion tube and a tube section on a side section of a stand. The insertion tube and the tube section are intended for mutual mounting for securing the bench to the stand. To prevent the bench from being lifted free from the mutual mounting, the bench is provided with a tube support provided with a foot clamp extending around a floor support and is secured to said support by means of a bolt.

From GB 1 296 128 a seating furniture according to the preambles of claim 1, claim 2 and claim 8 respectively are known. Each side frame of this seating furniture is fastened to the carrier beam independently. Each side frame is provided with a seat support and a foldable back support. The actual back and seat portions are mounted between each of the side frames. This construction is troublesome in both its assembly and its subsequent mounting, just as this seating furniture could be unstable and wobbly and the seating furniture itself could even fall apart if the fastening comes loose so that the side frame can slide on the beam.

As mentioned, the foot clamp is intended to prevent the bench from being lifted free from the mutual mounting between the insertion tube and the tube section on the side section of the stand. Fixedly securing the bench to the stand is achieved by means of the insertion tube and the tube section on the side section, said insertion tube and said tube section fixedly engaging each other.

U.S. Pat. No. 4,850,159 discloses a chair for a stadium for telescopic mounting on a transverse carrier beam. The chair is mounted on the carrier beam by means of two braces provided with tongues which engage slots in frames for the chairs and which extend around and on each side of the carrier element and are mutually secured by means of a bolt and a nut, the bolt extending through holes in the two braces. If the bolt and the nut are loosened and the two braces removed, it is possible to slide the chair along the carrier element and subsequently secure the chair again by means of the two braces, and the bolt and the nut.

This system possesses a disadvantage in that it is necessary to handle both a bolt and a nut and also handle two braces in order to mount the chair on the carrier beam or to loosen it from the carrier beam. This means that it is very difficult to mount a chair on or loosen a chair from the carrier beam, respectively. A fitter has to keep the nut positioned relative to the bolt when the bolt is tightened or loosened, has to see to it that the braces are not dropped from the stand, in for example a stadium, before or after the bolt and the nut are tightened or loosened, and also has to hold the chair so that the chair does not tip forwards or backwards before or after the bolt and the nut and the two braces are mounted or removed.

It is the object of the present invention to provide a chair for mounting on a carrier element, whereby the chair may be mounted so that it is quick and beset with fewer difficulties to mount and demount the seating furniture, and whereby only one person is required to mount and secure, and to loosen and demount, respectively, the searing furniture from the carrier element.

This object is achieved with seating furniture characterised in that the carrier element has an inner groove extending longitudinally to the carrier element, that the inner groove has an aperture to the groove itself, said aperture having a width which is less than the width of the inner groove itself, and that the fastening means has a part intended to cooperate with the brace and a part intended to cooperate with the inner groove.

Seating furniture according to the invention comprising only one brace and one fastening means for fastening to the carrier element makes it easy and uncomplicated to mount and fasten the furniture, as it is in effect possible to use just one hand when mounting and fastening the furniture to the carrier element, and also possible to hold the chair firmly to the carrier element with just one hand and with the other hand to mount and fasten a fastening means to secure the chair to the carrier element.

In an alternative embodiment, the seating furniture is characterised in that the seating furniture on a side opposite to the sitting surface, alternatively on a side opposite to the back resting surface, is provided with a profile, that the profile comprises two jaws extending in direction away from the sitting surface, alternatively away from the back resting surface, that a space is formed between the jaws, that the space is intended to receive the carrier element, and that at least one of the jaws is provided with at least one hole for fitting the fastening means.

Seating furniture according to the above preferred embodiment of the invention possesses a further advantage in that it is not even necessary to firmly hold the seating furniture to the carrier element with one hand. Once the seating furniture is positioned on the carrier element, the chair will hold itself to the carrier element in a fixed position for the seating furniture on the carrier element. Thus, it is possible, if necessary, to mount and fasten the fastening means with both hands in order to fasten the seating furniture to the carrier element.

In the following a chair will be used to describe the seating furniture according to the invention. Quick and considerably easier mounting and fastning of the chair to the carrier element and quick and easier demounting of the chair from the carrier element posses several advantages.

In connection with, for example, sporting events in a stadium where there is often much excitement, there is also the risk that a number of chairs may be damaged by the audience standing in the seats or on possible backs of the chairs. After a sporting event, it is therefore often necessary to replace a number of chairs.

Another advantage is that it is possible to make allowance for the possibility of quick and substantially easier replacement of the chairs by chairs in other colours or of different shapes, for example depending on whether it is a sporting event or perhaps a concert which is being held in the stadium. With the above features for the carrier element and the seating furniture, it is possible to use only one hand, alternatively two hands, when mounting and securing and demounting, respectively, the seating furniture to and from the carrier element.

In a preferred embodiment, the seating furniture is provided with a plate for use as a plate on the backside of a back of a piece of seating furniture, said plate having an edge section between an edge of the plate and a central part of the plate, and said edge section being provided with recesses for securing the plate to the backside of the back by means of bolts. The plate is characterised in that the edge has a first recess extending from the edge inwards into the edge section, and a second recess forming a hole in the edge section.

This results in a third advantage, namely that it is possible to make allowance for the possibility of replacing plates bearing the name of one sponsor by plates bearing the name of another sponsor, e.g. because of a wish for sponsorship of particular sporting events or a wish for sponsorship within a given period. With the above features for the plate, it is also possible when mounting and fastening, and demounting the plate, respectively, to do this using just one hand, alternatively using two hands.

Thus, the invention makes it possible for one person single-handed to undertake complete mounting and fastning of a piece of seating furniture to the carrier element, to single-handed loosen and demount the seating furniture from the carrier element to replace damage seating furniture or to replace the chairs by other pieces of seating furniture, and to single-handed undertake a possible replacement of plates on the back to change sponsor names.

In a preferred embodiment, the seating furniture is intended to be fastened to a substantially rectangular carrier element. The chair is preferably of a kind with a seat and a back, where the seat can be raised to a position in which the seat is substantially vertical.

DESCRIPTION OF THE DRAWINGS

The invention will now be explained in detail with reference to the accompanying drawing, in which

FIG. 1 shows a chair 1 in a first embodiment of a carrier element 10 with seating furniture according to the invention. The chair 1 is provided with a seat 2 which can be raised so that the seat 2 instead of being positioned substantially horizontally is positioned substantially vertically. The chair 1 comprises profiles 4 located on each side of the chair 1 (only the nearest profile is shown). A frame 5 for the seat is fastened to the profile 4 and is pivotally mounted relative to the profile 4 about hinges 6. A frame 7 for the back is secured to the profile 4 by means of bolts. The profile 4 is provided with a foremost jaw 8 and a rearmost jaw 9 both extending downwards in the shown view. The jaws 8,9 engage the carrier element 10. In the shown embodiment, the carrier element 10 has a substantially rectangular cross section. A space (not shown) between the jaws 8,9 has a cross section substantially corresponding to the cross section of the carrier element 10.

Figure 1:
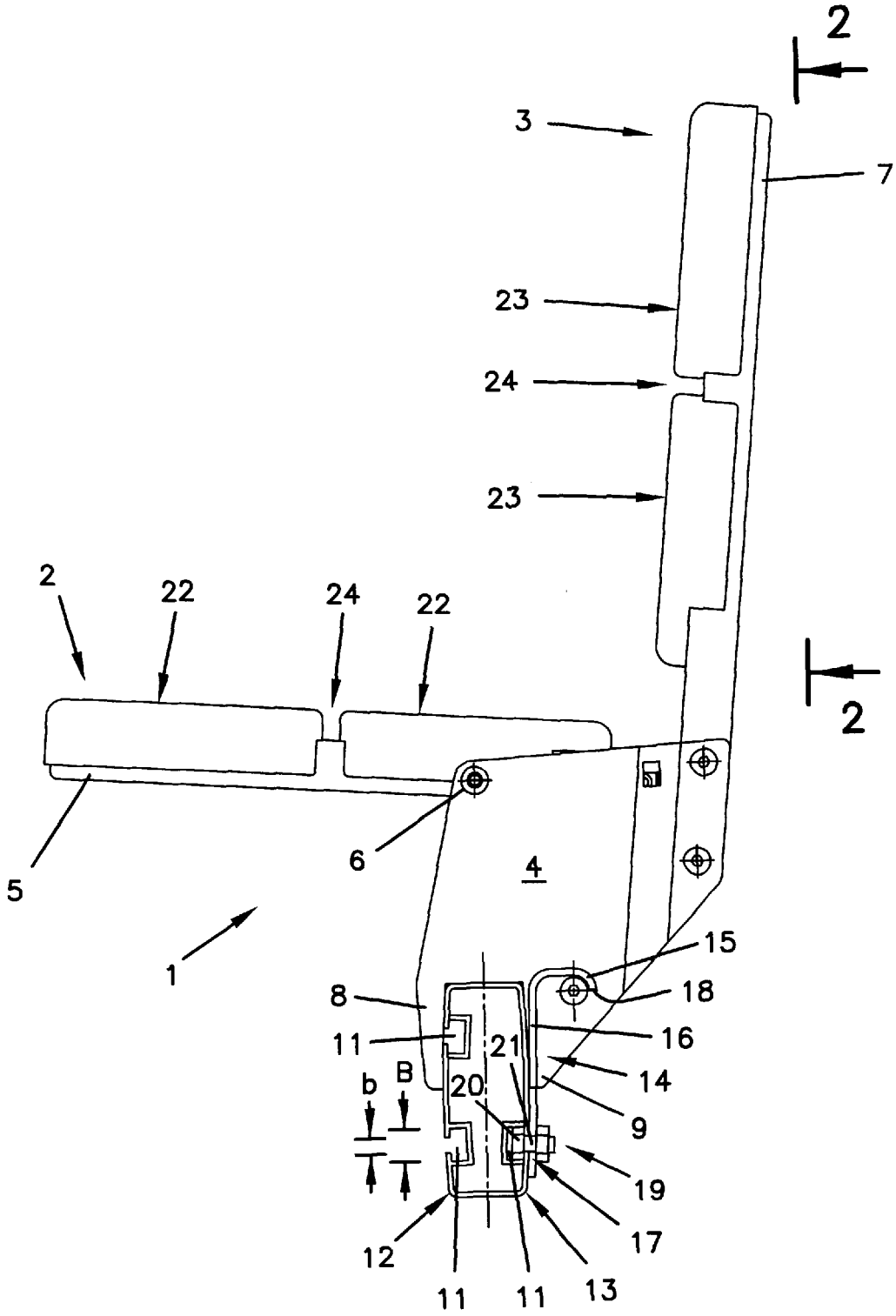
FIG. 1 is a plan view of a carrier element according to the invention and with seating furniture in the form of a chair according to the invention.

The carrier element 10 is fastened to a foundation (not shown). The foundation may be a natural foundation, like a ground surface in a park, such that the chairs make up sats in the park. The foundation may also be an established foundation, like a stand in a stadium so that the chairs make up seats in the stadium. The carrier element 10 has inner grooves 11 extending longitudinally to the carrier element 10, perpendicularly to the plane of the paper. The grooves 11 have an aperture of a width b which is less than the width B of the inner groove 11 itself.

The profile 4 with the jaws 8,9 forms an angular downwards facing U wherein the jaws 8,9 form branches in the U. The chairs 1 are mounted on the carrier element 10 by displacing the jaws 8,9 downwards over the carrier element 10 such that the jaws 8,9 extend downwards on opposite sides 12,13 of the carrier element 10. The jaws 8,9 are fastened to the carrier element 10 by means of one or more braces 14 with a fastening means. The brace has a curved part 15 and a plane part 16 with a hole 17. The curved part of the brace extends around a transverse bar 18 extending transversely to the chair between the profiles 4 in the chair 1, and which is secured to the profiles 4 on each side of the chair 1 by means of bolts.

In the shown embodiment, the fastening means are bolts 19. The bolts 19 comprise a head 20 and a shank 21. The head 20 engages one of the inner grooves 11 and the threaded shank extends outwards through the aperture in the groove and through the hole 17 in the plane part 16 of the brace 14. The brace 14 is thus secured to the carrier element 10 by means of the bolt. The head 20 has a special shape (shown in section) making it possible for the head 20 to be introduced into the inner groove 11 through the aperture, but preventing the head 20 from rotating all the way round in the groove 11 when the nut is tightened. Thus, the head 20 is substantially rectangular or oval with a width which is less than the width b of the aperture to the inner groove 11, and a length which is greater than the width B of the inner groove 11 itself. The head 20 of the bolt 19 may thus be passed through the aperture, but cannot rotate all the way round in the inner groove 11. In alternative embodiments, the fastening means may be rivets, screws, or other kinds of fastening means which make it possible later to loosen the brace 14 and then demount the chairs 1 from the carrier element 10. In an embodiment, the jaws 8,9 are made from aluminium, and bolts and nuts made from stainless steel secure the brace 14 to the carrier element 10. Hereby, there is achieved a combination of low density of aluminium facilitating the mounting of the chairs, and high strength of steel ensuring sufficient strength when fastning the brace 14 and thereby the chair by means of the fastening means 19.

In the shown embodiment, the brace 14 is mounted on a backside 13 of a carrier element 10 in a rearmost inner groove 11. Alternatively, it will be possible to mount the brace 14 on a front side 12 of the carrier element 10 in one of the foremost grooves 11. The brace must have a curved part 15 of another form to be able to extend around the transverse bar 18 extending transversely to the chair 1 between the profiles 4.

In the shown embodiment, there is shown a single brace 14. As an alternative to using a single brace 14, a plurality of braces 14 can be used, for example if the seating furniture is a bench instead of a chair. As an alternative to a head of the bolt engaging an inner groove, there may be used a bolt with a conventional hexagon head or head with an inner hexagon and on which the shank extends through the hole in the plane part of the brace and is screwed fast in a threaded hole on the backside, alternatively the front side, of the carrier element. However, the advantage of using a carrier element like the one shown is that it is possible to extrude the element without having to carry out subsequent machining of the element.

As illustrated, the seat 2 and the back 3 are preferably provided with two separate sitting surface 22 and two separate back resting surfaces 23, respectively. The sitting and back resting surfaces 22,23 comprise two parts, in between which two parts there are formed spaces 24. Another number than two sitting and back resting surfaces, respectively, may be used, e.g. a single or more than two sitting and back resting surfaces, respectively. The sitting and the back resting surfaces 22,23 are fastened to the frame 5 which is pivotally mounted to the profile 4 by means of the hinge 6 and to the frame 7 which is secured to the profile 4 by means of bolts, respectively.

Figure 4:
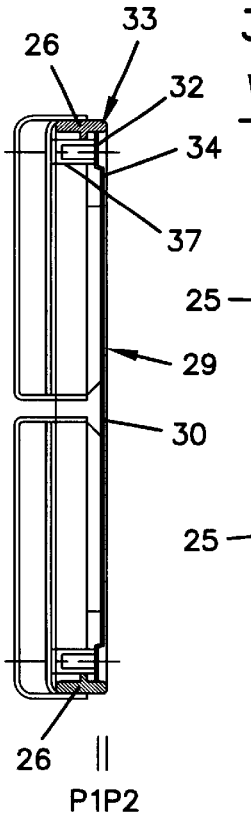
FIG. 4 is a side section view of the back for the chair according to the invention.
Figure 2:
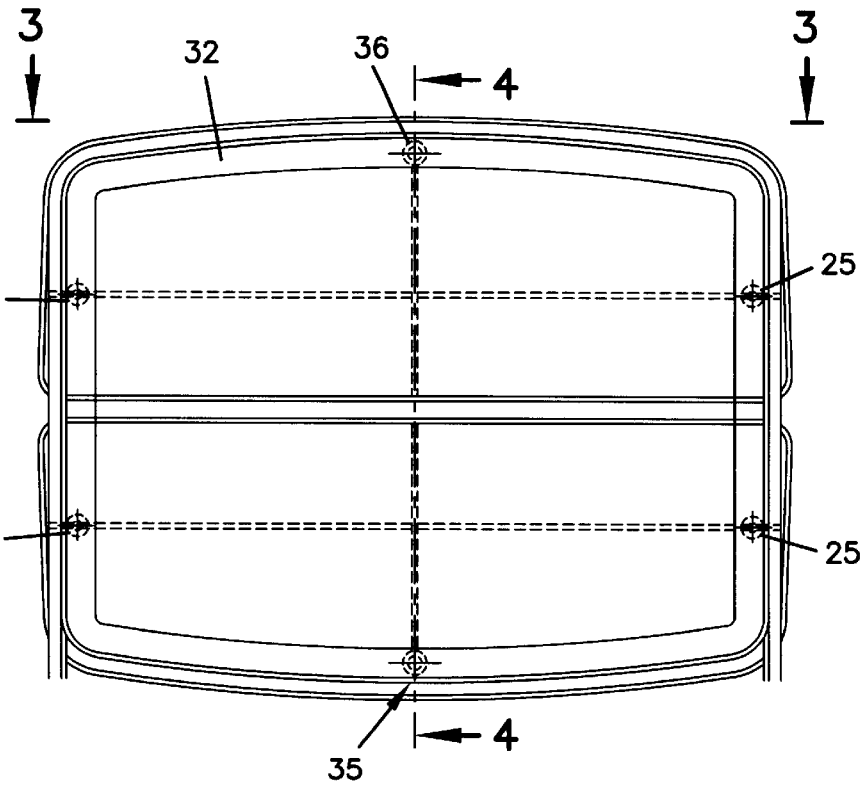
FIG. 2 is a plane view from the back of a back for a chair according to the invention.
Figure 3:
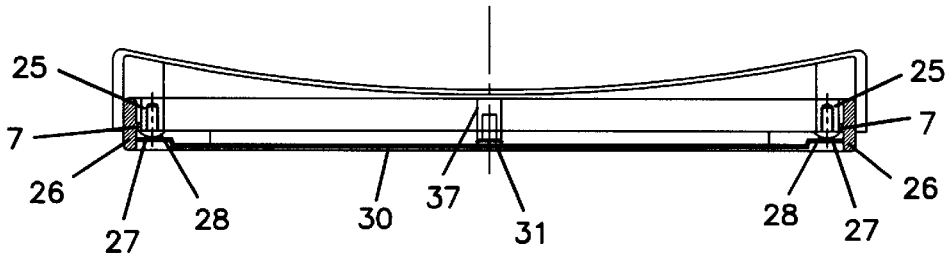
FIG. 3 is an elevated section view of the back for the chair according to the invention.

FIGS. 2–4 show plane views and sections, respectively, of a back for a piece of seating furniture according to the invention. Each of the two parts of the separate sitting surfaces 22 and back resting surfaces 23, respectively, is provided with bushes 25 extending downwards and backwards, respectively, relative to the actual sitting surface and back resting surface, respectively. The bushes 25 are preferably intended for fastening of self-tapping screws. The seat frame 5 and the back frame 7, respectively, are provided with a flange 26 along an internal edge of the frames 5,7. Self-tapping screws 27, alternatively bolts, with washers 28 are screwed in the bushes 25 on each of the two parts of the sitting surface 22 and the back resting surface 23, respectively, such that the washer 28 is in contact with the flange 26 along the seat frame 5 and the back frame 7, respectively. In this way each of the two parts of the sitting surface and the back resting surface, respectively, is secured to the seat frame 5 and the back frame 7, respectively.

In the shown embodiment the back frame 7 is provided with a back plate 30 extending in a plane behind the back 3. The back plate has a surface 29 facing backwards relative to the chair and which may be used for advertising or other kinds of information. The back plate 30 is secured to the two parts 23 constituting the back 3 by means of bolts or screws 31.

The back plate 30 has an edge section 32 extending between an edge 33 of the back plate and a central part 34 of the back plate. The edge section 32 is formed in a plane P1 which is slightly displaced relative to a plane P2 for the central part 34 of the back plate. The edge section 32 is provided with a first recess 35 and a second recess 36. The first recess 35 is a U-shaped groove extending from the edge 33 partly inwards into the edge section 32. The second recess 36 is just a hole.

Mounting of the back plane 30 takes place by means of the bolts or the screws 31 engaging further bushes 37 on either of the two parts 23 of the back 3. The further bushes 37 may either be actual threaded bushes in which case bolts 31 are used, or be bushes intended for fastening of self-tapping screws 31. A lower bush 37 is preferably for self-tapping screws 31, whereas an upper bush 37 is preferably a threaded bush for a bolt 31, or vice versa, as it is only necessary to loosen or tighten the bolt 31 in the upper or the lower of the further bushes 37 to loosen or secure the plate 30 to the back. Initially it is possible to have one bolt partly mounted whereafter the first recess 35 in the edge section 32 of the back plate is displaced inwards in a space between the bush 37 and the head of the bolt 31. Then the second bolt may be positioned and secured through the hole which forms the second recess 36 in the edge section 32.

In the shown embodiment the jaws 8,9 of the profile 4 extend downwards in the profile 4 and are fastened to a carrier element 10 positioned under the chair. In an alternative embodiment the jaws 8,9 may extend backwards in the profile 4 and be fastened to a carrier element 10 positioned behind the chairs 1.

The profile 4 is preferably made from metal such as stainless steel or aluminum and the parts 22,23 of the seat 2 and the back 3 are preferably made from plastic. As mentioned, the parts of the seat 2 and the back 3 are provided with the bushes 25 for engaging the self-tapping screws or bolts 27, and the screws or the bolts 27 are provided with heads, if necessary, with intermediate washers 28 engaging flanges 26 along the seat frame 5 and the back frame 7, respectively. Thus, it is possible without considerable difficulties to mount and demount the parts 22 of he seat 2 and the parts 23 of the back 3 on and from the seat frame 5 and the back frame 7, respectively.

Figure 5:
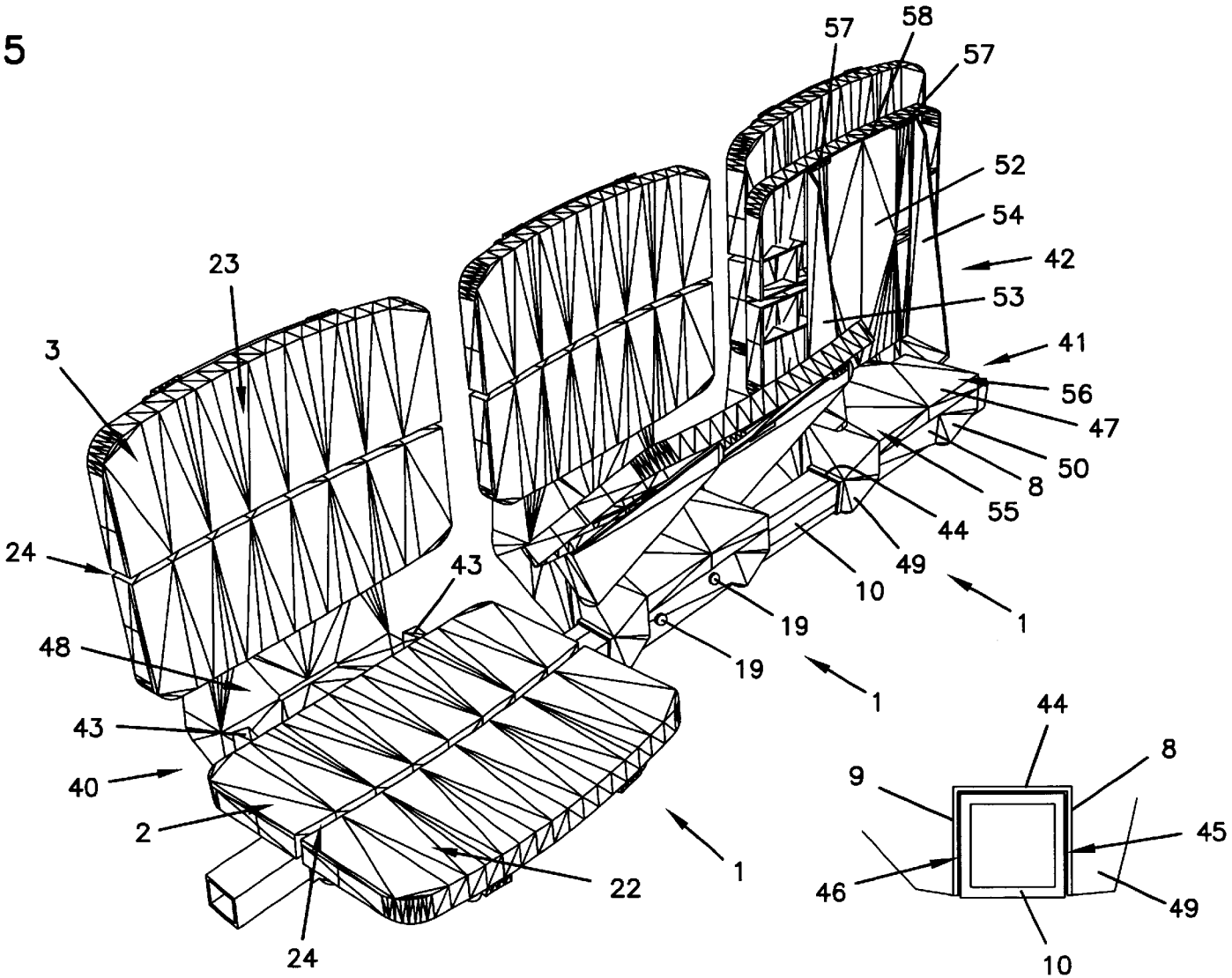
FIG. 5 is an alternative embodiment for a carrier element according to the invention and with alternative embodiments of seating furniture in the form of chairs according to the invention.

FIG. 5 shows an alternative embodiment of a carrier element and seating furniture according to the invention. The seating furniture is shown in the form of three chairs 1. The chairs 1 are provided with a seat 2 which can be raised so that the seat 2 is in contact with a back 3 of the chairs 1. Each chair comprises a profile 40 extending behind the back 3 and below the seat 2. The profile 40 comprises a fixed part 41 and a movable part 42. The movable part 42 is pivotally mounted relative to the fixed part 41 about hinges 43. The fixed part 41 is provided with a foremost jaw 8 and a rearmost jaw 9 (see section) both extending downwards in the shown view. The jaws 8,9 engage a carrier element 10. In the shown embodiment, the carrier element 10 has a rectangular cross section and a space (not shown) between the jaws 8,9 has a cross section substantially corresponding to the cross-section of the carrier element.

The carrier element 10 is fastened to a foundation (not shown). The foundation may be a natural foundation, like a ground surface in a park such that the chairs make up seats in the park. The foundation may also be an established foundation, like a stand in a stadium such that the chairs make up seats in the stadium.

The profile 4 with the jaws 8,9 forms an angular downwards facing U wherein the jaws 8,9 form branches in the U, and in which a flange 44 of the profile 4 forms a bottom in the U between the jaws 8,9 forming, as mentioned, the branches in the U. The chairs are mounted on the carrier element 10 by displacing the jaws 8,9 downwards over the carrier element 10 such that the jaws 8,9 extend downwards on opposite sides 45,46 (see section) of the carrier element 10. The jaws 8,9 are fastened to the carrier element 10 by means of fastening means.

In the shown embodiment the fastening means are bolts 19 extending through threaded holes (not shown) formed in the foremost jaw 8. In an alternative embodiment, the fastening means may be rivets, screws, or other kinds of fastening means which make it possible later to demount the chairs from the carrier element 10 if necessary. In an embodiment the jaws 8 are made from aluminium, and nuts of steel are fastened to the foremost jaw 8 opposite holes in the carrier element 10 or steel linings are mounted in holes in the carrier element 10. Hereby, there is achieved a combination of low density of aluminium facilitating the mounting of the chair, and high strength of steel ensuring sufficient strength when fastening the jaws and also the chair by means of the fastening means.

In the shown embodiment the bolts 14 are tightened inwardly from the foremost jaw 8 to the adjacent side 45 of the carrier element 10 so that the rearmost jaw 9 is in close contact with the adjacent side 46 of the carrier element 10. Thus, the chairs 1 cannot directly be demounted from the carrier element 10.

As an alternative to two bolts 10, one bolt may be used. Alternatively to tightening the bolt to the side 45 of the carrier element 10, the carrier element may be provided with holes through which the bolts 10 extend. If the carrier element 10 is provided with threaded holes, the holes in the foremost jaw 8 may be ordinary unthreaded holes.

As illustrated, the seat 2 and the back 3 are preferably provided with separate sitting surfaces 22 and back resting surfaces 23, respectively. The sitting and back resting surfaces 22, 23 are comprised of two parts, in between which two parts there is formed a space 24. The sitting and back resting surfaces 22,23 are fastened to the movable part 42 of the profile 40 and the fixed part 41 of the profile 40, respectively.

In the shown embodiment, the fixed part 41 of the profile 40 is provided with a supporting plate 47 extending in a plane under the seat 2 substantially parallel with the seat 2 is a position in which the seat 2 is lowered down. In the shown embodiment, the fixed part 41 of the profile 40 is also provided with a back plate 48 extending in a plane substantially parallel with a back 3. The fixed part 41 of the profile 40 is furthermore provided with stiffening ribs 49,50 extending in planes substantially perpendicularly relative to the supporting plate 47 and the back plate 48.

In the shown embodiment the movable part 42 of the profile 40 is provided with a seating plate 52 extending substantially parallel with the sitting surface 22. The movable part 42 of the profile 40 is furthermore provided with stiffening ribs 53,54 extending in planes under the seat substantially perpendicularly to the seating plate 52.

In the shown embodiment, the supporting plate 47 of the fixed part 41 of the profile 40 is a substantially rectangular cross section with corners 55,56. This may be a disadvantageous as there is a risk of squeezing ones fingers between the stiffening ribs 53,54 on the movable part 42 of the profile 40 and the corners 55,56 of the supporting plate 47 of the fixed part 41 of the profile 40 when the seat 2 is lowered down. When the seat 2 from the position in contact with the back 3 is lowered to a sitting position, there is a risk of squeezing ones fingers between the seat 2 and the seating plate 52 with the seat in the shown embodiment. In an alternative embodiment the supporting plate 47 of the fixed part 41 of the profile 40 is consequently triangular or trapezoidal such that the corners 55,56 illustrated in the shown embodiment either are not present or at least are positioned at a distance from the stiffening ribs 53,54 of the movable part 42 of the profile 40 when the seat 2 is lowered down.

In the shown embodiment the jaws 8,9 of the profile 40 extend downwards from the supporting plate 47 and are fastened to the carrier element 10 located under the chairs 1. In an alternative embodiment the jaws 8,9 may extend backwards from the back plate 48 or backwards relative to the profile 40 and be fastened to a carrier element 10 located behind the chairs 1.

The profile 40 is preferably made from metal, such as stainless steel or aluminium, and the seat 2 and the back 3 are preferably made from plastic. The parts of the seat 2 and the back 3 are provided with hooks 57 engaging edge sections (not shown) of the back plate and edge sections 58 of the seating plate 52 for the movable part 6 of the profile, respectively. This makes it possible, without considerable difficulties, to mount and demount the parts of the seat 2 and the back 3 on the seating plate 52 for the movable part 42 of the profile 40 and the back plate 48, respectively.

In the Figures, the chair is shown in an embodiment wherein the seats can be pivoted relative to the profile 4. In an alternative embodiment, the chairs may be provided with seats which are fixed relative to the profile 4. In such an alternative embodiment, the chairs are also provided with a seat and a back. The seat, however, cannot be raised relative to the back. The chairs also comprise a profile, which, as in the Figures, is provided with a foremost jaw and a rearmost jaw extending downwards or backwards. In such an alternative embodiment, the jaws are also intended to engage the carrier element 10.

In the shown embodiments of the chairs according to the invention, the jaws are shown with straight jaw surfaces, and the carrier element is shown with a substantially rectangular cross section. It will be possible to use jaws with curved jaw surfaces, and the carrier element may have a triangular, other polyangular, oval or circular cross section. In the shown embodiments of the chairs, the chairs are provided with seat as well as back. It will be possible to provide chairs which only have seats, possibly with sitting surfaces extending longitudinally to the carrier element to form benches. In the shown embodiment the seat can be pivoted relative to the back. It will be possible to provide a chair where the back can also be pivoted, or where only the back can be pivoted.

What is claimed is:

1. Seating furniture comprising:

a carrier element comprising:

an inner groove that extends longitudinally along the carrier element; and an aperture that leads to the inner groove, said aperture having a width (b) that is less than a width (B) of the inner groove; and a seat comprising:

a sitting surface;

a profile located on a side opposite the sitting surface, the profile comprising two jaws that extend in a direction away from the sitting surface, the jaws forming a space between the jaws that is arranged and configured to receive the carrier element; and a brace that is arranged and configured to fixedly hold the jaws in relation to the carrier element, the brace being fastened to the carrier element via a second fastening means, the second fastening means having a first part that is arranged and configured to cooperate with the brace and a second part that is arranged and configured to cooperate with the inner groove;

wherein the carrier element is arranged and configured to be fastened to a natural or established foundation.

2. The seating furniture of claim 1, further comprising a bar that extends transversely to the seating furniture.

3. The seating furniture of claim 2, wherein the brace comprises a curved part that curves around the bar.

4. The seating furniture of claim 1, wherein the second fastening means comprises a bolt with a nut, the bolt having a head arranged and configured to cooperate with the inner groove.

5. The seating furniture of claim 4, wherein the head of the bolt has a width that is greater than the width (b) of the aperture but is less than the width (B) of the inner groove.

6. The seating furniture of claim 1, wherein the carrier element further comprises a plurality of parallel inner grooves that extend longitudinally along the carrier element.

7. The seating furniture of claim 1, wherein the seat further comprises a seat frame, the seat frame being provided with a flange that extends along the seat frame.

8. The seating furniture of claim 7, wherein the seat further comprises a plurality of bushings that are arranged and configured to engage with seat fasteners that are used to fixedly secure the seat to the seat frame by contacting the flange on the seat frame.

9. The seating furniture of claim 1, further comprising a back that comprises a back resting surface fastened to a back frame, the back frame comprising a flange that extends along the back frame.

10. The seating furniture of claim 9, wherein the back further comprises a plurality of bushings that are arranged and configured to engage with back fasteners that are used to fixedly secure the back to the back frame by contacting the flange on the back frame.

11. The seating furniture of claim 1, wherein the jaws form a first branch and a second branch of a U-profile.

12. The seating furniture of claim 11, further comprising a flange that extends between the first branch and the second branch of the U-profile, thereby forming a bottom of the U-profile;

wherein a distance between the first branch and the second branch is substantially equal to a width of the carrier element.

13. The seating furniture of claim 1, further comprising a plate that is arranged and configured to be used as a back cover on a back side of the seating furniture.

14. The seating furniture of claim 13, wherein the plate comprises an edge section that is positioned between an edge of the plate and a central part of the plate, the edge section comprising recesses that are arranged and configured for fastening the plate to the back side of the seating furniture by means of threaded fastening means;

wherein the edge includes a first recess that extends from the edge inwards into the edge section and a second recess that forms a hole in the edge section.

15. Seating furniture comprising:

a carrier element comprising:

an inner groove that extends longitudinally along the carrier element; and an aperture that leads to the inner groove, said aperture having a width (b) that is less than a width (B) of the inner groove; and a seat comprising:

a sitting surface;

a back resting surface;

a profile located on a side opposite the back resting surface, the profile comprising two jaws that extend in a direction away from the back resting surface, the jaws forming a space between the jaws that is arranged and configured to receive the carrier element; and a brace that is arranged and configured to fixedly hold the jaws in relation to the carrier element, the brace being fastened to the carrier element via a second fastening means, the second fastening means having a first part that is arranged and configured to cooperate with the brace and a second part that is arranged and configured to cooperate with the inner groove;

wherein the carrier element is arranged and configured to be fastened to a natural or established foundation.

16. The seating furniture of claim 15, further comprising a bar that extends transversely to the seating furniture.

17. The seating furniture of claim 16, wherein the brace comprises a curved part that curves around the bar.

18. The seating furniture of claim 15, wherein the second fastening means comprises a bolt with a nut, the bolt having a head arranged and configured to cooperate with the inner groove.

19. The seating furniture of claim 18, wherein the head of the bolt has a width that is greater than the width (b) of the aperture but is less than the width (B) of the inner groove.

20. The seating furniture of claim 15, wherein the carrier element further comprises a plurality of parallel inner grooves that extend longitudinally along the carrier element.

21. The seating furniture of claim 15, wherein the seat further comprises a seat frame, the seat frame being provided with a flange that extends along the seat frame.

22. The seating furniture of claim 9, wherein the seat further comprises a plurality of bushings that are arranged and configured to engage with seat fasteners that are used to fixedly secure the seat to the seat frame by contacting the flange on the seat frame.

23. The seating furniture of claim 15, wherein the jaws form a first branch and a second branch of a U-profile.

24. The seating furniture of claim 23, further comprising a flange that extends between the first branch and the second branch of the U-profile, thereby forming a bottom of the U-profile;

wherein a distance between the first branch and the second branch is substantially equal to a width of the carrier element.

25. The seating furniture of claim 15, further comprising a plate that is arranged and configured to be used as a back cover on a back side of the seating furniture.

26. The seating furniture of claim 25, wherein the plate comprises an edge section that is positioned between an edge of the plate and a central part of the plate, the edge section comprising recesses that are arranged and configured for fastening the plate to the back side of the seating furniture by means of threaded fastening means;

wherein the edge includes a first recess that extends from the edge inwards into the edge section and a second recess that forms a hole in the edge section.

* * * * *